US005931424A

United States Patent [19]

Kerber

[11] Patent Number: 5,931,424

[45] **Date of Patent: *Aug. 3, 1999**

[54] WARNING LINE STAND

[76] Inventor: Nick Martin Kerber, 519 SE. Kane, Roseburg, Oreg. 97470

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,100

[22] Filed: Mar. 18, 1996

[51] Int. Cl.[6] ..... E04G 1/36

[52] U.S. Cl. ..... 248/158; 182/45; 248/166; 248/171; 248/237; 256/1; 256/DIG. 6

[58] Field of Search ..... 248/163.1, 165, 248/166, 167, 168, 169, 170, 171, 431, 434, 158, 237; 52/152; 182/45; 256/1, 47, 48, DIG. 6

[56] References Cited

U.S. PATENT DOCUMENTS

| | | | |
|---|---|---|---|
| 704,073 | 7/1902 | Mole | 256/47 X |
| 1,194,927 | 8/1916 | Armstrong | 248/431 |
| 2,493,978 | 1/1950 | Kromer | 248/171 |
| 2,734,727 | 2/1956 | Hensley | 256/48 |
| 4,023,307 | 5/1977 | Clark et al. | 256/47 X |
| 5,165,635 | 11/1992 | Hoshino | 248/169 |
| 5,263,550 | 11/1993 | Jines et al. | 256/DIG. 6 X |
| 5,301,910 | 4/1994 | Lang et al. | 248/166 |
| 5,307,897 | 5/1994 | Turner et al. | 182/3 |
| 5,318,258 | 6/1994 | Lang | 248/166 |
| 5,647,451 | 7/1997 | Reichel | 182/45 |

OTHER PUBLICATIONS

Exhibit A: Perimeter Warning Line System ad from Cleasby Mfg. Co. catalog, 1995, p. 26; 1414 Bancroft Ave, San Francisco, Ca 94124.

Exhibit B: Warning Line System brochure from Roof Cranes, 1995, 29295 NW Buxton Lookout Rd., Banks, Or 97106.

Exhibit C: Speedstand Warning Line System brochure of this applied invention, 1995, from Nick Kerber and Quicksilver Engineering, 864 SE Flint, Roseburg, Or 97470.

*Primary Examiner*—Derek J. Berger

[57] ABSTRACT

A one-piece warning line stand that easily changes between a compact folded position and an opened position with a simple sliding motion, locks in the opened position, and has a tilted post that holds a warning line in a vertical plane outside the footprint of the stand.

11 Claims, 3 Drawing Sheets

36
7
2
C
35
34

WARNING LINE STAND

BACKGROUND OF THE INVENTION

I. Field of the Invention

This invention relates to stands used with warning lines to provide fall protection.

II. Fall Protection

Safety Engineers have found that falls are the most frequent cause of deaths in the construction industry. In the United States of America, the Occupational Safety and Health Administration (OSHA) has set specifications of a number of acceptable methods of fall protection for various situations.

Warning line systems provide acceptable fall protection for work performed on flat rooftops. A warning line system consists of a rope and stands which fence off the perimeter of a work area. The rope (called a warning line) is fastened from stand to stand. When a worker moves out of the work area, he contacts the warning line and is alerted to the fall danger.

OSHA specifications for warning line systems require that stands have a quantity of resistance to being knocked over, and that the warning lines hang neither too high or too low to effectively warn a worker.

III. Commercial Use

Commercial use of fall protection has been subject to business economics. While fall protection has reduced accidents and the high cost of injuries, its use has also increased the cost of construction by requiring the cost of additional equipment, labor to set up and use the protection, reduced efficiency due to the restriction of movement, the burden of working around the protection, and the cost of removing it. The net result has been increased cost which is passed on to the consumer.

Construction companies have sought to reduce the costs by choosing protection systems that are inexpensive, easy to use, and improve their workers' productivity. In flat rooftop construction, warning line systems have been popular because of their portability, and flexibility to a variety of roof geometries. Construction companies have found that warning line systems that use light, compact, one-piece, quickly set up stands allow the cheapest cost of fall protection. Stands that lie out of the work area increase the speed of work and decrease costs.

IV. Description of Prior Art

An early stand consisted of a concrete filled tire with an embedded steel post. They often weighed over 90 pounds, were awkward to lift and difficult to transport to the job site because they were large and could not be stacked efficiently.

Another stand consisted of a steel base plate with a stud welded to its center onto which a length of pipe could be could be inserted. Although more compact than concrete filled tires, the base plate stands still weighed 50 pounds, were awkward to lift, and stacked poorly in a heavy, menacing pile.

Another stand consisted of a base of two long bars that formed an X upon which a post was pinned. It folded by removing the pin, pivoting the base bars together, setting the post lengthwise onto the bars, and repinning the parts together into an approximately rectangular package that made stacking more compact than other stands. Although the stands were approximately rectangular, they included a protruding handle that made stacking more than one high difficult, and they required several manipulations to setup and take down.

All previous art has used a post set vertically in the center of a base. Consequently, when the warning line is strung from stand to stand it sets above the center of each base, making part of the base of each stand lie within the work area. When working near the perimeter of the work area, the bases of the stands are in the way and roof workers often untie the stands and move them out of the way to complete their work. The presence of the bases in the work area interrupts work and reduces efficiency. Other drawbacks include the need for field assembly.

SUMMARY OF THE INVENTION

To avoid the limitations and problems with present warning line stands, this invention provides a one-piece folding stand that opens and folds with a single linear motion, locks simply in the opened position, stacks compactly, and includes a tilted post that allows the stand to lie out of the vertical plane of the warning line.

These and other objects of the invention are provided by a novel post, legs, braces, and slider. The post includes and a number of pivoting means at one end, each upon which the end of a leg pivots. One end of a brace pivots at a point along the length of each leg. The other end of each brace also pivots upon one of a number of pivoting means of a slider. The inside of the slider is slightly larger than the outside of the post so that the slider is able to slide along a portion of the post. The proportions of the parts, the coupling of the slider to the braces, the coupling of the braces to the legs, and the coupling of the legs to the post allows the slider in an upper position of the post to position the braces and legs against the outside surface of the post in a compact, folded position. Additionally, the proportions of the parts and the couplings further allow the slider in another lower position of the post to position the front legs at acute angles to the post and the rear legs at obtuse angles to the post so that the legs lie nearly in a plane and the post is at an angle to the plane. The post in this opened position is tilted at an angle to the surface so that the top end of the post is in a vertical plane that does not include any part of the legs or braces of the stand. A movable stop in the length of the post secures the slider to the post to hold the stand in the opened position.

Still other aspects and advantages of the preferred embodiment will in part be obvious and will in part be apparent from the specification and drawings.

The invention is embodied in the features of construction, combination of elements, and arrangements of parts which will be exemplified in the constructions hereinafter set forth, and the scope of the invention will be indicated in the claims.

DESCRIPTION OF THE PREFERRED EMBODIMENTS

I. The First Preferred Embodiment

Figure 1:
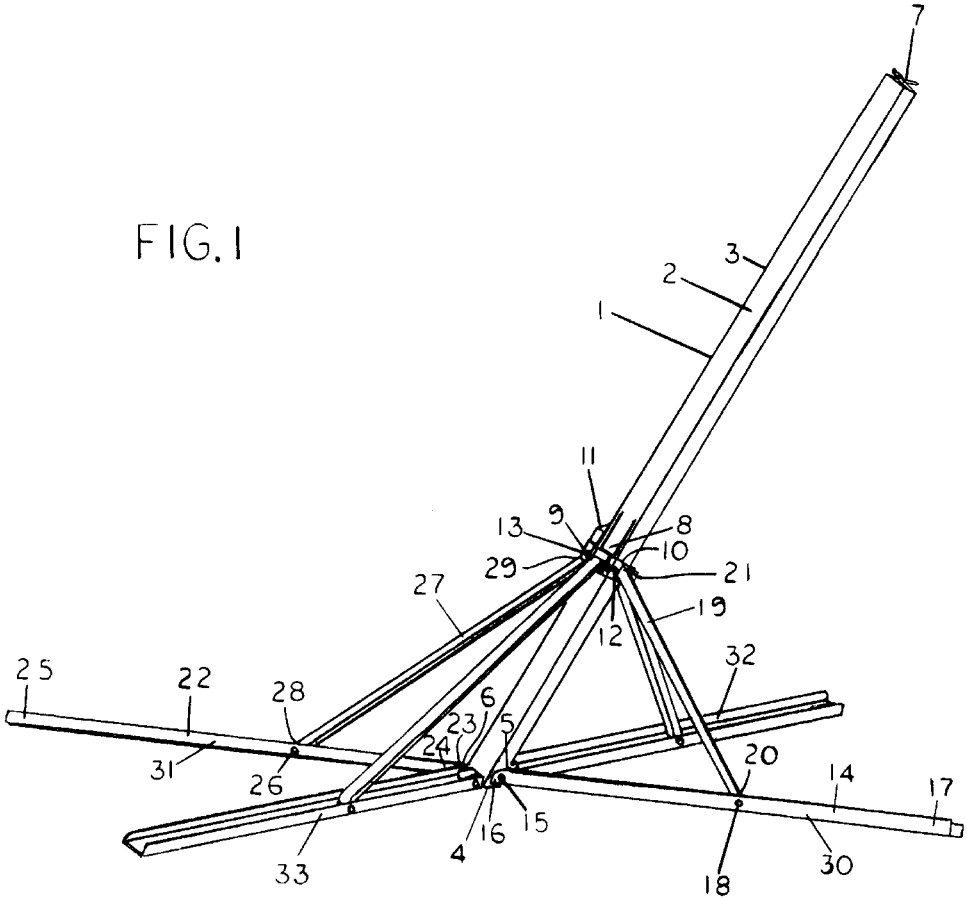
FIG 1 is a perspective view of the first preferred embodiment in the opened position.
Figure 2:
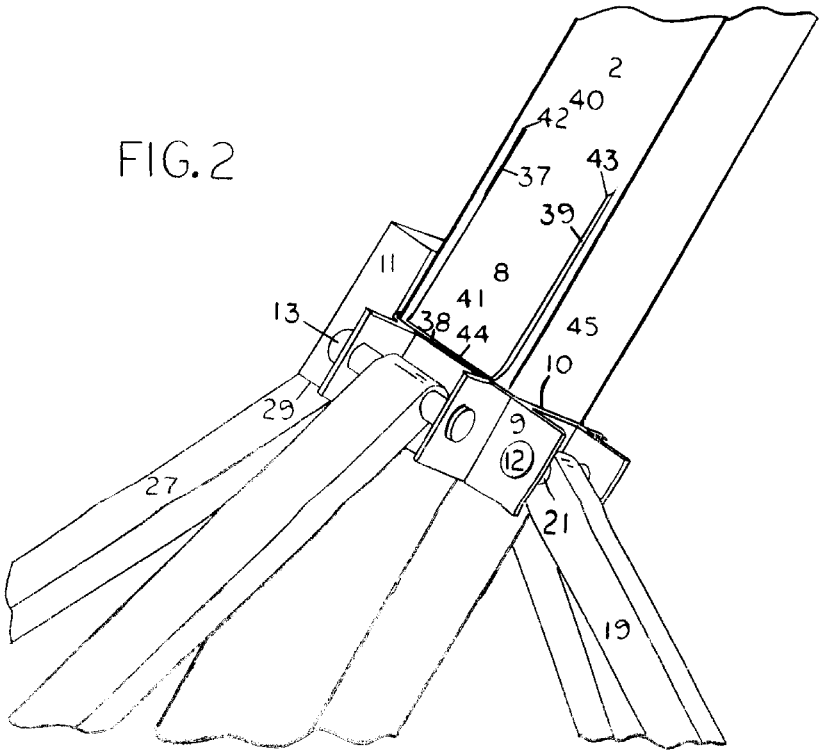
FIG. 2 is an expanded view of the slider assembly of FIG. 1.

In the first preferred embodiment, referring to FIGS. 1 and 2, a stand 1, includes a post 2, with an outside surface 3, a beveled end 4, post front pivoting means 5, post rear pivoting means 6, a rope fastening means 7, and a movable stop 8. Slider 9 has an inside surface 10 that fits outside the outside surface 3 of post 2, a handle 11 and a number of pivoting means including slider front pivoting means 12, and slider rear pivoting means 13. A front leg 14 includes a front leg post pivoting means 15 at front leg post end 16, front leg outside end 17, and front leg brace pivoting means 18. A front brace 19 includes a front brace leg pivoting means 20 at one end, and a front brace slider pivoting means 21 at the other end. A rear leg 22 includes a rear leg post pivoting means 23 at rear leg post end 24, rear leg outside end 25, and rear leg brace pivoting means 26. A rear brace 27 includes a rear brace leg pivoting means 28 at one end, and a rear brace slider pivoting means 29 at the other end. Front assembly 30 comprises front leg 14 and front brace 19. Rear assembly 31 comprises rear leg 22 and rear brace 27.

Slider 9 slides along outside surface 3 of post 2. Slider 9, front brace 19, front leg 14, and post 2 are coupled with the following three planar pivoting joints. Specifically, slider 9 is fastened to front brace 19 at slider front pivoting means 12 and front brace slider pivoting means 21. Front brace 19 is fastened to front leg 14 at front brace leg pivoting means 20 and front leg brace pivoting means 18. Front leg 14 is fastened to post 2 at front leg post pivoting means 15 and post front pivoting means 5. Additionally, slider 9, rear brace 27, rear leg 22, and post 2 are also coupled with the following three planar pivoting joints. Specifically, slider 9 is fastened to rear brace 27 at slider rear pivoting means 13 and rear brace slider pivoting means 29. Rear brace 27 is fastened to rear leg 22 at rear brace leg pivoting means 28 and rear leg brace pivoting means 26. Rear leg 22 is fastened to post 2 at rear leg post pivoting means 23 and post rear pivoting means 6.

Figure 3:
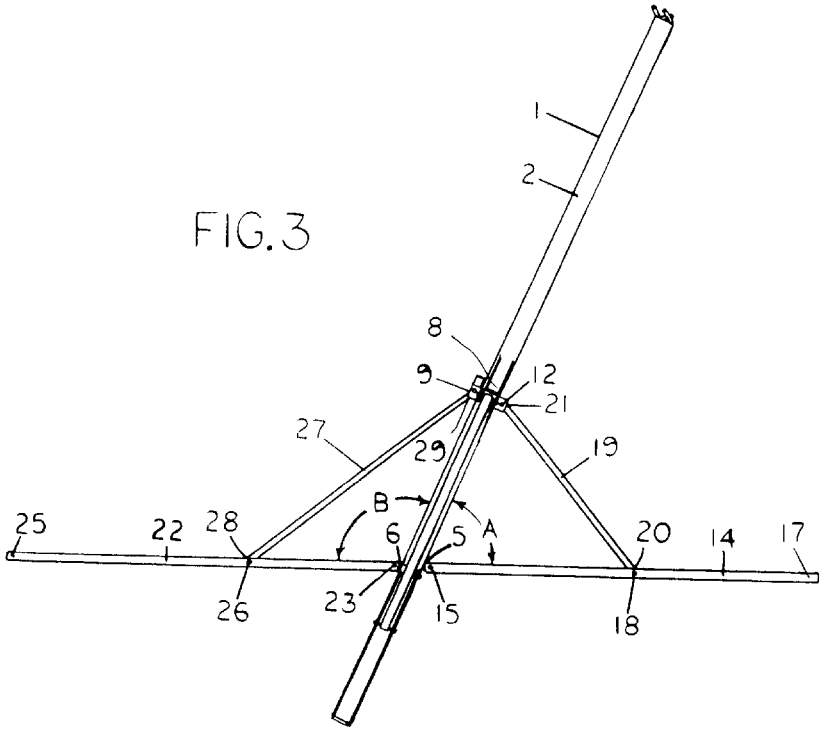
FIG. 3 is a side elevation view of the warning line stand in the opened position.

Referring to FIG. 3, when stand 1 is in the opened position, it contacts the roof surface, also called the support surface, at front leg outside end 17 and rear leg outside end 25. The downward gravitational weight of stand 1 is counteracted by upward forces from the roof surface acting at front leg outside end 17 and rear leg outside end 25. These forces are transmitted through front brace 19 and rear brace 27 to force slider 9 upward against movable stop 8, securing slider 9 against movement and fixing the position of slider 9 to post 2. The fixed position of slider 9 locks front brace 19, the section of front leg 14 from front leg brace pivoting means 18 to front leg post pivoting means 15, and the section of post 2 from movable stop 8 to post front pivoting means 5 in a triangular geometry and allows front brace 19 to strengthen and stabilize the orientation of post 2 to front leg 14. Rear brace 27, the section of rear leg 22 from rear leg brace pivoting means 26 to rear leg post pivoting means 23, and the section of post 2 from movable stop 8 to post rear pivoting means 6 are similarly locked in a triangular geometry, allowing rear brace 27 to strengthen and stabilize the orientation of post 2 to rear leg 22. This is the opened position of stand 1.

Figure 4:
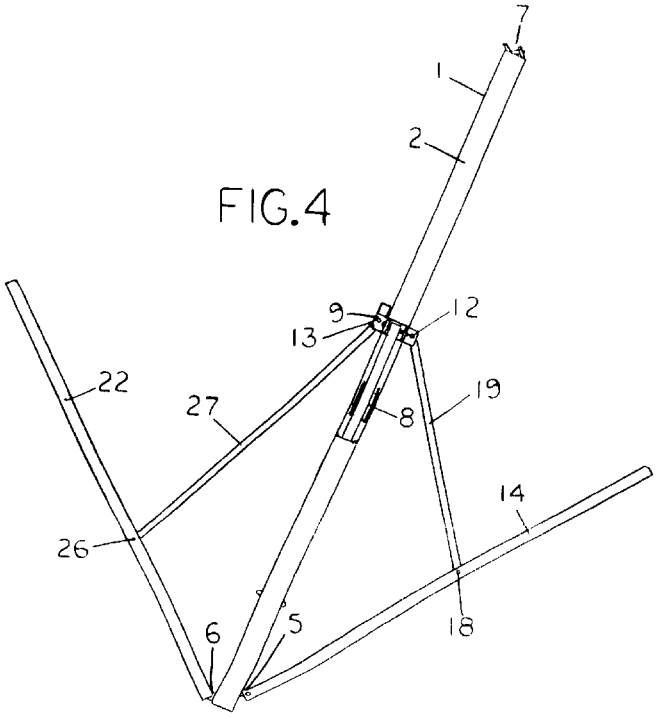
FIG. 4 is a side elevation view of the warning line stand in a position intermediate between the opened and folded position.

Referring to FIGS. 3 and 4, when movable stop 8 is moved, slider 9 is free to move along post 2. When handle 11 of slider 9 is pulled up toward the rope fastening means 7 of post 2, slider 9 slides upward, and front brace 19 is pulled upward and pivots inward toward post 2 about slider front pivoting means 12. Front brace 19 exerts an upward force on front leg 14 at front leg brace pivoting means 18 causing front leg 14 to pivot upward toward post 2 about post front pivoting means 5. Simultaneously, rear brace 27, and rear leg 22 act in a similar manner as front brace 19, and front leg 14 respectively. Rear brace 27 is pulled upward and pivots inward toward post 2 about slider rear pivoting means 13, and exerts an upward force on rear leg 22 at rear leg brace pivoting means 26. Rear leg 22 pivots upward toward post 2 about post rear pivoting means 6.

Figure 5:
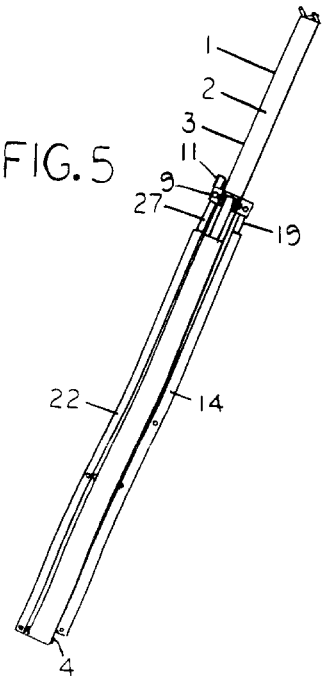
FIG. 5 is a side elevation view of the warning line stand in the folded position.

Referring to FIGS. 4 and 5, slider 9 slides upward until front brace 19, front leg 14, rear brace 27, and rear leg 22 lie against the outside surface 3 of post 2. This is the folded position of stand 1.

Referring to FIG. 5, showing stand 1 in the folded position, when handle 11 of slider 9 is pushed downward toward beveled end 4 of post 2, slider 9 slides down post 2 as shown in FIG. 4, front brace 19 pivots outward from post 2 about slider front pivoting means 12, and exerts an outward force on front leg 14 at front leg brace pivoting means 18. Front leg 14 pivots outward from post 2 about post front pivoting means 5. At the same time, rear brace 27, and rear leg 22 act in a similar manner as front brace 19, and front leg 14 respectively. Rear brace 27 pivots outward from post 2 about slider rear pivoting means 13, and exerts an outward force on rear leg 22 at rear leg brace pivoting means 26. Rear leg 22 pivots outward from post 2 about post rear pivoting means 6.

Referring to FIG. 3, when slider 9 slides down to movable stop 8, slider 9 is secured against movable stop 8 from further movement, fixing the position of slider 9 to post 2 and locking stand 1 is in the opened position.

In this way the simple movement of a movable slider allows a one-piece stand to be locked in the opened position or folded in a compact, closed position.

Referring to FIGS. 3 and 5, the opened and folded orientations of front leg 14 to post 2 can be set by choosing the lengths of the following linkages:

1) the length from the pivoting center of front leg post pivoting means 15 to the pivoting center of front leg brace pivoting means 18,
2) the length from the pivoting center of front brace leg pivoting means 20 to the pivoting center of front brace slider pivoting means 21, and
3) the length from the pivoting center of slider front pivoting means 12 when slider 9 is against movable stop 8 to the pivoting center of post front pivoting means 5.

These lengths can be set to give both a chosen angle A between post 2 and front leg 14 in the opened position, and so that front brace 19 and front leg 14 lie against the outside surface 3 of post 2 in the folded position.

Additionally, the orientations of rear leg 22 to post 2 in the opened and folded positions can be set by choosing the lengths of the following linkages:

4) the length from the pivoting center of rear leg post pivoting means 23 to the pivoting center of rear leg brace pivoting means 26, and
5) the length from the pivoting center of rear brace leg pivoting means 28 to the pivoting center of rear brace slider pivoting means 29.

Given the length of 3), lengths 4) and 5) can be set to give both a chosen angle B between post 2 and rear leg 22 in the opened position and so that rear brace 27 and rear leg 22 lie against the outside surface 3 of post 2 in the folded position. In this way the angles between the post and the legs in the opened position can be set while ensuring compact and complete closing.

For stability and simplicity it is often desirable for the long sides of post 2 to consist of an extruded rectangle and for stand 1 to additionally include, as shown in FIG. 1, a second front assembly 32, and a second rear assembly 33. Second front assembly 32 is a duplicate of front assembly 30 and comprises a duplicate of front leg 14 and a duplicate of front brace 19. Second front assembly 32 pivots about and fits on a duplicate of post front pivoting means 5 and a duplicate of slider front pivoting means 12. Second rear assembly 33 is a duplicate of rear assembly 31 and comprises a duplicate of rear leg 22 and a duplicate of rear brace 27. Second rear assembly 33 pivots about and fits on a duplicate of post rear pivoting means 6 and a duplicate of slider rear pivoting means 13. In the folded position of stand 1, the four legs and braces lie against the outside surface 3 of post 2 and stand 1 has sides comprised of legs that are roughly rectangular and allow compact stacking and storage of a number of stands.

When the stand is locked in the opened position, the legs form a base with the leg outside ends in a horizontal plane upon which the stand rests. In use, stands set on a roughly flat, horizontal surface called a deck or support surface. Lines between the outside ends of adjacent legs define the outside edges of the base.

Figure 6:
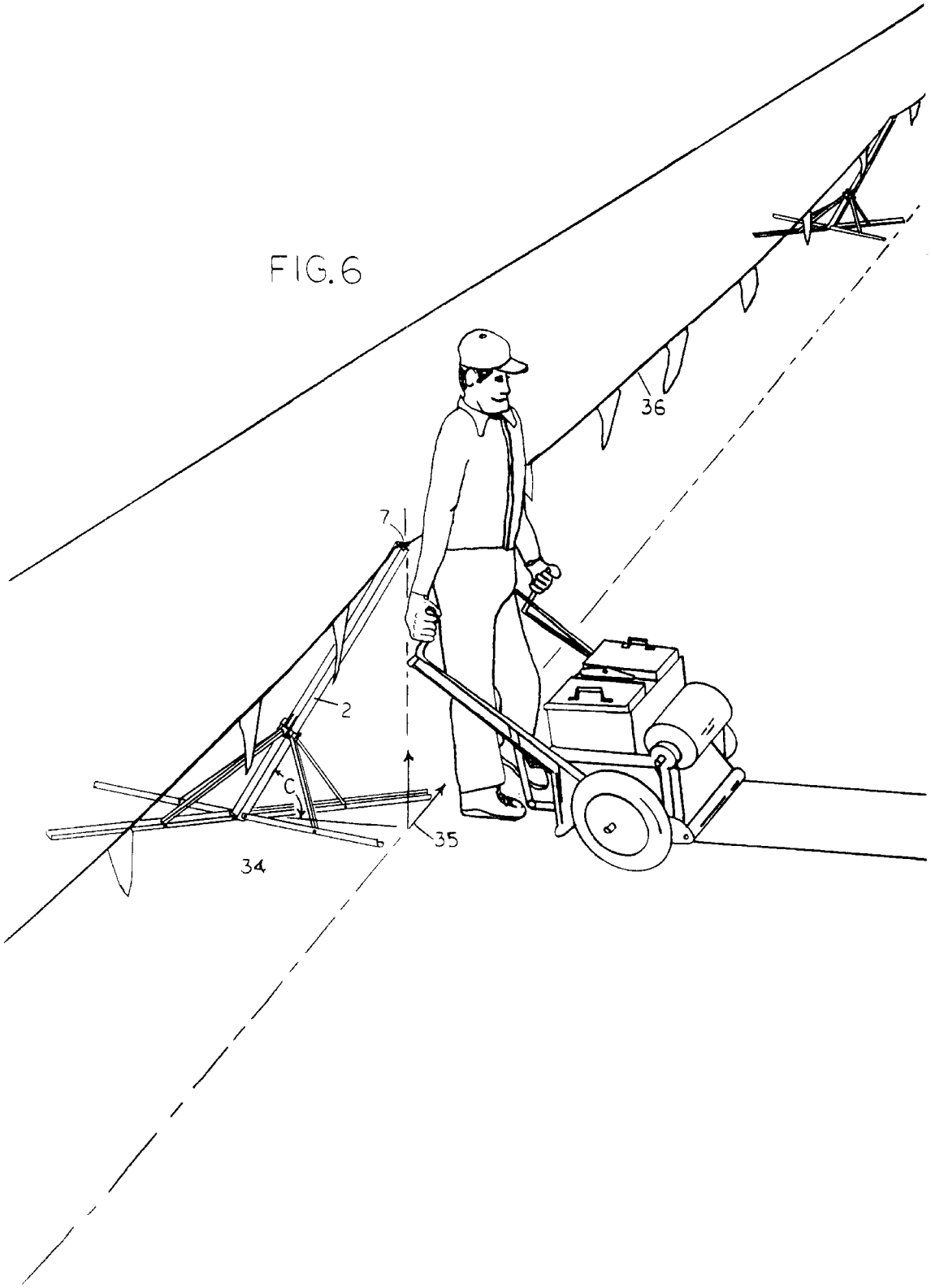
FIG. 6 is a perspective view of warning line stands set up in a warning line system.

When a warning line system is set up as shown in FIG. 6 with the stands in the opened position, it is desirable to have the angle C between post 2 and the support surface 34 to be such that there is a vertical plane 35 through rope fastening means 7 that does not intersect any of the legs. This allows a warning line 36 strung between two stands to provide a restraint to movement while keeping the structure of the stands outside the vertical plane 35 of the restraint and further allows stands to hold a warning line which ropes off the perimeter of a work area without the stands interfering with the work performed inside the work area. The perimeter of the work area is also referred to as the work perimeter.

The first preferred embodiment provides a one-piece stand that easily and quickly changes to and from the folded and opened positions with a simple sliding motion, locks in the opened position, has a tilted post that holds a warning line in a vertical plane that lies outside the footprint of the stand, and closes compactly for easy storage.

II. The Second Preferred Embodiment

Referring to FIG. 2, a slot consisting of a first cut 37, second cut 38, and third cut 39 in tube 40 creates a cantilever ear 41, integral with tube 40, anchored about a line from end 42 of first cut 37 to end 43 of third cut 39. When cantilever ear 41 is bent so that end 44 normally lies above the outside surface 45 of tube 40, a force at end 44 directed inward to tube 40 can cause ear 41 to move elastically inward to tube 40, so as to provide an elastic ear 41 that lies outside the tube or can be forced inside tube 40. The end 44 of ear 41 provides a movable stop to an object sliding along surface 45, and in particular, referring to FIG. 3, provides a simple movable stop 8 to slider 9 that locks stand 1 in the opened position.

Although the invention is described with respect to the preferred embodiments, modifications thereto will be apparent to those skilled in the art. Therefore, the scope of the invention is to be determined by reference to the claims that follow.

I claim:

1. A warning line system for restricting movement of workers beyond the perimeter of a work area on a support surface comprising;

a line defining the work perimeter, a plurality of line supports for suspending the line between at least two spaced-apart locations above the support surface, wherein at least one of the line supports comprises a free-standing warning line stand comprising a base positionable on the support surface, a support means mounted to the base for supporting the line at one of the locations, and a rope fastening means mounted to said support means for fastening and supporting said line, said rope fastening means lying outside a vertical plane adjacent to an outside edge of said base.

2. A warning line system according to claim 1 wherein said base is substantially outside the work perimeter.

3. A warning line system according to claim 2 wherein said support means is a straight post and sets at an angle to the base other than normal.

4. A warning line system according to claim 3 wherein said post further comprises a number of pivoting means near the bottom of said post and said base is comprised of legs, each of said legs including an inside, first end with a first pivoting means, and an outside, second end, each of said first pivoting means secured to one of said pivoting means of said post, said legs pivotingly connected about said pivoting means of said post, and able to pivot from an opened, first position with said outside, second end of each of said legs on the support surface, to a folded second position adjacent to the outside surface of said post.

5. A warning line system according to claim 4 further comprising braces with first and second ends, each of said braces secured at said first end of said brace to one of said legs and at said second end of said brace to said post, fixing each of said legs relative to said post in said opened, first position.

6. A warning line system according to claim 5, said legs each further comprising a second pivoting means at a selected position along the length of said leg, said braces each further comprising a first pivoting means at said first end of said brace, and a second pivoting means at said second end of said brace, and further comprising a slider which slides along the length of the outside surface of said post, and includes a number of pivoting means, each of said braces secured at said first pivoting means of said brace to said second pivoting means of said leg, said brace able to pivot about said leg, each of said braces also secured at said second pivoting means of said brace to one of said pivoting means of said slider, said brace able to pivot about said slider, said slider movable along the length of said post, including said opened, first position wherein said slider is secured in a locked position to said post, indirectly securing each of said braces to said post and movable to said folded, second position wherein said braces and said legs lie adjacent to the outside surface of said post.

7. A warning line system according to claim 6, said post being tubular and including a movable stop comprised of a U-shaped slot in said post, and an ear interior to said slot and integral to said post, one end of said ear which moves elastically and in a first position lies outside a cross sectional perimeter of said post, and in a second position lies at or inside the cross sectional perimeter of said post, so that when said ear is in said first position it forms a stop to movement of said slider, securing said slider to said post in said opened, first position of said slider, and when said ear is in said second position it allows movement of said slider past said ear to said folded, second position of said slider.

8. A method of suspending a warning line between at least two spaced-apart locations above a support surface with a line support means, said warning line consisting of a line for restricting the movement of workers on said support surface, said line support means comprising a free-standing base, a support means mounted to said base, and a rope fastening means mounted to said support means for fastening and supporting said warning line, said method comprising the steps of positioning said base of said line support means on said support surface, and supporting the line with said line support means at one of the locations relative to said base outside a vertical plane adjacent to an outside edge of said base.

9. A method of suspending a warning line according to claim 8 where the warning line defines a work perimeter, wherein said base is substantially outside the work perimeter.

10. A warning line stand for use on a support surface comprising;

a post with rope fastening means near a top end, a movable stop, and four pivoting means near a bottom end;

a slider with an inside surface which slides along the outside surface of said post and includes four pivoting means;

four legs, each leg including a first pivoting means at an inside, first end, a second pivoting means at a selected position along its length, and an outside, second end, each of said legs fastened at said first pivoting means of said leg to said post at one of said pivoting means of said post, so that said legs pivot about said post;

four braces, each brace with a first pivoting means at a first end and a second pivoting means at a second end, each of said braces fastened at said first pivoting means of said brace to one of said legs at said second pivoting means of said leg, so that each of said braces pivot at said first pivoting means of said brace about one of said second pivoting means of one of said legs, and each of said second pivoting means of said brace is fastened to one of said pivoting means of said slider, so that each of said braces pivots additionally at said second pivoting means of said brace about one of said pivoting means of said slider, said legs, braces, and slider movable from an opened, first position with said slider locked in a selected position along said post against upward movement along said post by said movable stop in a locked, first position, said movable stop connected to said post, and against downward movement along said post by the force of the support surface resulting from the gravitational weight of said warning line stand, so that a portion of each of said legs forms a triangle with one of said braces, and a portion of said post;

said movable stop movable to an unlocked, second position, allowing upward movement of said slider along said post;

said slider movable between said opened, first position wherein said slider lies in said selected lower portion of said post to a folded, second position in an upper portion of said post, said legs each simultaneously pivoting about said post, and said braces each simultaneously pivoting about said one of said legs, and about said slider so that said legs and said braces fold along said outside surface of said post.

11. A warning line stand according to claim 10 wherein when said stand is in the said opened, first position, said post lies at an angle not normal to the support surface.

* * * * *